US010404000B2

(12) United States Patent
Gruber

(10) Patent No.: US 10,404,000 B2
(45) Date of Patent: Sep. 3, 2019

(54) SPRING-LOADED CONTACT PIN

(71) Applicant: Rosenberger Hochfrequenztechnik GmbH & Co. KG, Fridolfing (DE)

(72) Inventor: Andreas Gruber, Laufen (DE)

(73) Assignee: ROSENBERGER HOCHFREQUENZTECHNIK GMBH, Fridolfing (DE)

( * ) Notice: Subject to any disclaimer, the term of this patent is extended or adjusted under 35 U.S.C. 154(b) by 1 day.

(21) Appl. No.: 15/773,231

(22) PCT Filed: Mar. 8, 2016

(86) PCT No.: PCT/EP2016/054932
§ 371 (c)(1),
(2) Date: May 3, 2018

(87) PCT Pub. No.: WO2017/152959
PCT Pub. Date: Sep. 14, 2017

(65) Prior Publication Data
US 2018/0323529 A1 Nov. 8, 2018

(51) Int. Cl.
*H01R 13/24* (2006.01)
*H01R 12/57* (2011.01)

(52) U.S. Cl.
CPC ..... *H01R 13/2421* (2013.01); *H01R 13/245* (2013.01); *H01R 12/57* (2013.01); *H01R 13/2478* (2013.01); *H01R 2201/20* (2013.01)

(58) Field of Classification Search
CPC ..... H01R 13/2421; H01R 13/245; H01R 2201/20; H01R 13/17; H01R 13/187; H01R 13/18
See application file for complete search history.

(56) References Cited

U.S. PATENT DOCUMENTS 4,068,913 A * 1/1978 Stanger ..... H01R 13/53 218/146
4,192,572 A * 3/1980 Stanger ..... H01H 33/045 218/150
5,151,040 A * 9/1992 Tanaka ..... G01R 1/0466 439/700
6,861,862 B1 * 3/2005 Tate ..... G01R 1/0466 324/756.02
7,008,270 B1 3/2006 Huh et al.
7,316,592 B2 * 1/2008 Chan ..... H01R 13/2421 200/530

(Continued)

FOREIGN PATENT DOCUMENTS

CN 2867642 Y 2/2007
EP 1251374 A2 10/2002

(Continued)

OTHER PUBLICATIONS

Machine Translation of JP2009294149.
Machine Translation of CN2867642Y.

*Primary Examiner* — Briggitte R. Hammond
(74) *Attorney, Agent, or Firm* — David P. Dickerson

(57) ABSTRACT

Spring-loaded contact pin having a sleeve (101); a spring arranged in the sleeve (101); a piston which is arranged at least partially in the sleeve (101); and a contact element which is arranged at least partially in the sleeve (101) and which is configured so as to contact the sleeve (101) and the piston (107).

18 Claims, 4 Drawing Sheets

(56) References Cited

U.S. PATENT DOCUMENTS

| | | | | |
|---|---|---|---|---|
| 7,625,227 | B1 * | 12/2009 | Henderson | H01R 13/6275 439/350 |
| 7,625,247 | B1 * | 12/2009 | Mahoney | H01R 9/0527 439/63 |
| 2006/0051997 | A1 | 3/2006 | Kooiman | |
| 2009/0011662 | A1 * | 1/2009 | Yumi | H01R 13/2421 439/840 |
| 2011/0018567 | A1 * | 1/2011 | Shiga | G01R 1/06722 324/754.11 |
| 2013/0095707 | A1 * | 4/2013 | Kim | H01R 13/08 439/840 |
| 2013/0330983 | A1 | 12/2013 | Difonzo et al. | |
| 2015/0325939 | A1 | 11/2015 | Kim et al. | |

FOREIGN PATENT DOCUMENTS

| | | | |
|---|---|---|---|
| EP | 2180326 | A1 | 4/2010 |
| JP | 2002022768 | A | 1/2002 |
| JP | 2005308684 | A | 11/2005 |
| JP | 2006071343 | A | 3/2006 |
| JP | 2009294149 | A | 12/2009 |
| WO | 2006025510 | A1 | 3/2006 |
| WO | 2013055630 | A1 | 4/2013 |

* cited by examiner

SPRING-LOADED CONTACT PIN

FIELD OF THE INVENTION

The present invention relates to a spring-loaded contact pin and to a method for manufacturing a spring-loaded contact pin.

DESCRIPTION OF THE PRIOR ART

Spring-loaded contact pins, spring-loaded contacts or spring-loaded pins are contacting elements which are used for testing electronic components. Spring-loaded contact pins are also used in releasable electrical plug connections.

The contacting is here produced by touching by means of a spring-assisted pin. Other names from the technical jargon are test pin, test tip, spring contact or Pogo® pin.

US 2013/0330983 A1 discloses a spring-loaded contact pin having a sleeve, a spring, an insulating cone and a piston.

The piston occasionally becomes tilted in the sleeve in the case of known spring-loaded contact pins. This is a cause of passive intermodulation.

SHORT DESCRIPTION OF THE INVENTION

Against this background, the object of the present invention is to provide a spring-loaded contact pin with reduced passive intermodulation.

The present invention addresses this problem by ensuring a homogeneous contact between the piston and the sleeve in a spring-loaded contact pin.

According to the invention, the homogeneous contact of the piston on the sleeve may be ensured by the contact element by virtue of the contact element contacting the piston and the sleeve over their entirety.

According to an alternative of the invention, a homogeneous contact of the piston on the sleeve can also be provided by avoiding a contact in a head-side end region of the sleeve and also by ensuring a lower contact of the piston on the sleeve by means of the spring.

Advantageous embodiments and developments become apparent from the claims and from the description with reference to the drawings.

The present disclosure teaches embodiments of a spring-loaded contact pin assembly as recited in the annexed claims.

The present disclosure furthermore teaches a spring-loaded contact pin having a sleeve; a spring arranged in the sleeve; a piston which is arranged at least partially in the sleeve; and a contact element which is arranged at least partially in the sleeve and which is configured so as to contact the sleeve and the piston.

The present disclosure furthermore teaches a manufacturing method for a spring-loaded contact pin having a length of 8 mm to 15 mm and/or having a diameter of between 0.5 mm and 3 mm, with the steps: providing a sleeve; inserting a spring into the sleeve; mounting a contact element, in particular a contact ring with contact tongues, in the sleeve; and inserting a piston into the sleeve.

According to a further embodiment of the invention, the contact element is may be designed as a contact ring, in particular with springy contact elements. A complete homogeneous contact between the sleeve and the piston is thus ensured even when lateral forces are exerted. As a result, the homogeneous contact is further improved. In addition, the springy contact tongues produce a certain tolerance compensation by virtue of the contact tongues holding the piston centrally in the contact ring.

According to a further embodiment, an insulating part may be arranged in the sleeve, between the piston and the spring. As a result, contact between the underside of the piston and the spring or the sleeve is prevented.

According to a further embodiment, the insulating part may be made from plastic, glass or ceramic. The said materials have particularly advantageous sliding properties and manufacturing properties. Advantageous sliding properties of the insulating part reduce the spring force required during the contacting and have a positive effect on the lifetime of the spring-loaded contact pin.

According to a further embodiment, the piston may be arranged in a bore of the insulating part. The piston is thus further secured against possible tilting.

According to a further embodiment, the piston may be manufactured from wire and has a thread at a spring-side end. As a result, manufacturing steps can be saved. Wire is available cost-effectively in different material compositions and diameters. Moreover, wire can be processed particularly simply in standardized manufacturing processes.

The thread at the spring-side end of the piston secures the piston in the insulating part. The insulating part preferably has a thread corresponding to the piston thread. A thread is understood to be indentations, for example helical or circular indentations. Multiple helical and/or circular indentations in different directions can be superposed.

According to a further embodiment, the length of the spring-loaded contact pin may be between 8 mm and 15 mm, in particular between 10 mm and 12 mm, and/or the diameter of the spring-loaded contact pin is between 0.5 mm and 3 mm, in particular between 1.3 mm and 2 mm. With the said dimensions, a spring-loaded contact pin can be provided which has particularly favorable properties.

According to a further embodiment of the invention, a holding element which is configured to hold the insulating part relative to the sleeve may be formed in the head part-side end region of the sleeve. The holding element can be designed as an angled web and secures the insulating part in the sleeve.

According to a further alternative embodiment of the invention, the contact element may be designed as a circular ring with angled contact tongues. The springs and the piston are arranged inside the circular ring and the angled contact tongues. The contact tongues are enclosed at least partially by the sleeve. In this way, a signal or current runs essentially over the contact element. Accordingly, the region inside the contact tongues is essentially free of grease. An insulating part is consequently not an absolutely essential part of the design of the invention.

According to a further embodiment of the invention, the piston may have a step which is configured so as to interact with a corresponding inner abutment element of the sleeve in order to hold the piston in the sleeve. More preferably, the sleeve has guide surfaces corresponding to the piston, on an inner surface. In this way, guidance for the piston is provided which prevents the piston from being tilted in the spring-loaded contact pin.

According to a further embodiment of the invention, the contact element may have latching elements which are configured so as to latch to the sleeve. The latching elements can, for example, be designed as claws.

According to a further embodiment of the invention, the sleeve may be manufactured from plastic.

The above embodiments and developments can, where appropriate, be combined with each other in any form. Further possible embodiments, developments and implementations of the invention also comprise combinations not explicitly mentioned of features of the invention which are described above or below with respect to the exemplary embodiments. In particular, a person skilled in the art will here also add individual aspects as improvements or supplements to the respective basic form of the present invention.

DESCRIPTION OF THE DRAWINGS

The present invention is explained in detail below with the aid of the exemplary embodiments provided in the schematic drawings, in which.

Figure 1:
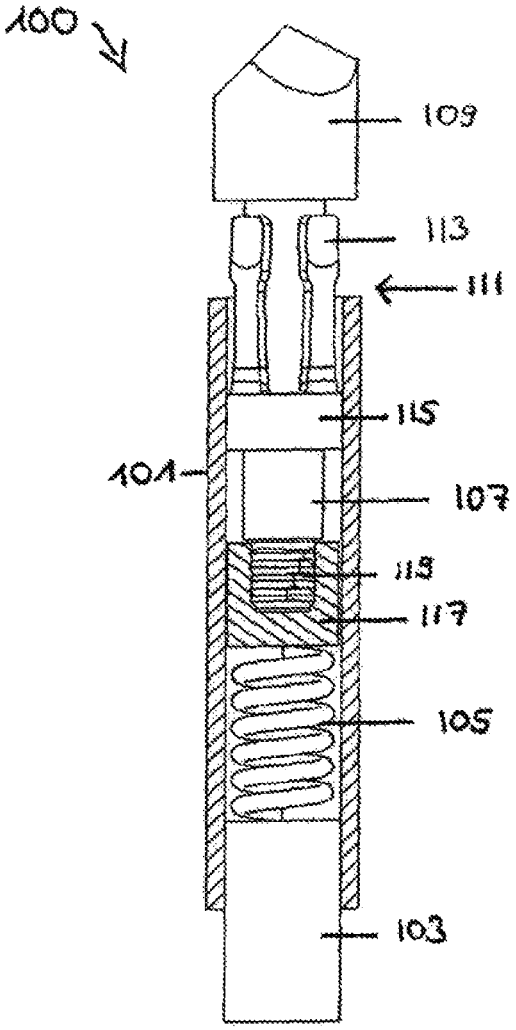
FIG. 1 shows an embodiment of a spring-loaded contact pin according to the invention.

The attached drawings are intended to enable further understanding of the embodiments of the invention. They illustrate embodiments and, together with the description, serve to explain principles and concepts of the invention. Other embodiments and many of the advantages mentioned are apparent from the drawings. The elements of the drawings are not necessarily shown to scale.

Identical, functionally similar elements, features and components and those with the same effect are in each case provided with the same reference numerals in the drawings.

DESCRIPTION OF EXEMPLARY EMBODIMENTS

Although the present invention has been described completely above with the aid of preferred exemplary embodiments, it is not restricted thereto and instead can be modified in many different fashions.

FIG. 1 shows a schematic view in section of a spring-loaded contact pin 100 according to the invention. The spring-loaded contact pin 100 has a sleeve 101, a fastening element 103 for fastening the spring-loaded contact pin, which is designed as a bolt in FIG. 1, a spring 105, an insulating part 117, a piston 107 and a contact element 111 which in FIG. 1 is designed as a contact ring 105 with springy contact tongues 113.

The bolt 103 serves to anchor the spring-loaded contact pin 100, for example on a printed circuit board or in a housing. In FIG. 1, the bolt 103 is inserted into the sleeve 101 and fastened thereto. It is, however, conceivable that the bolt 103 and the sleeve 101 are manufactured from one part.

The spring 105 is arranged inside the sleeve 101. In the untensioned state, the spring 105 displaces the insulating part 117, the piston 107 and the contact element 111 towards the head part-side end of the sleeve 101. When the spring-loaded contact pin 100 is plugged in, the spring 105 is compressed so that the said components are displaced backwards, towards the bolt 103.

In FIG. 1, the piston 107 is arranged in a bottom region inside the insulating part 117. The contour of the insulating part 117 is designed so that it corresponds to the internal contour of the sleeve 101, such that tilting of the insulating part 117 relative to the sleeve 101 is prevented as far as possible. The piston 107 has a thread 119 in the bottom region. The bottom region of the piston 107 can in particular have multiple thread contours, for example opposite thread contours. A person skilled in the art will understand multiple thread contours to mean multiple helices having different parameters such as height, radius, angle, etc.

The piston 107 is arranged in a bore of the insulating part 117. It is conceivable that the insulating part, inside the bore, has a thread which is actively connected to the thread of the piston.

In FIG. 1, the contact ring 115 contacts the piston 107 and the sleeve 101. Moreover, the springy contact tongues 113 are angled in such a way that they contact both the piston 107 and the sleeve 101. Depending on the force exerted to press the contact tongues 113 onto the sleeve 101 and onto the piston 107, it is not absolutely necessary for the contact ring 115 to contact the sleeve 101 or the piston 107.

In FIG. 1, the head part 109 of the piston 107 has a polygonal geometry. A person skilled in the art knows that the head part geometry can be adapted as required for specific applications. The piston 107 is in particular manufactured from multiple individual parts.

Figure 2:
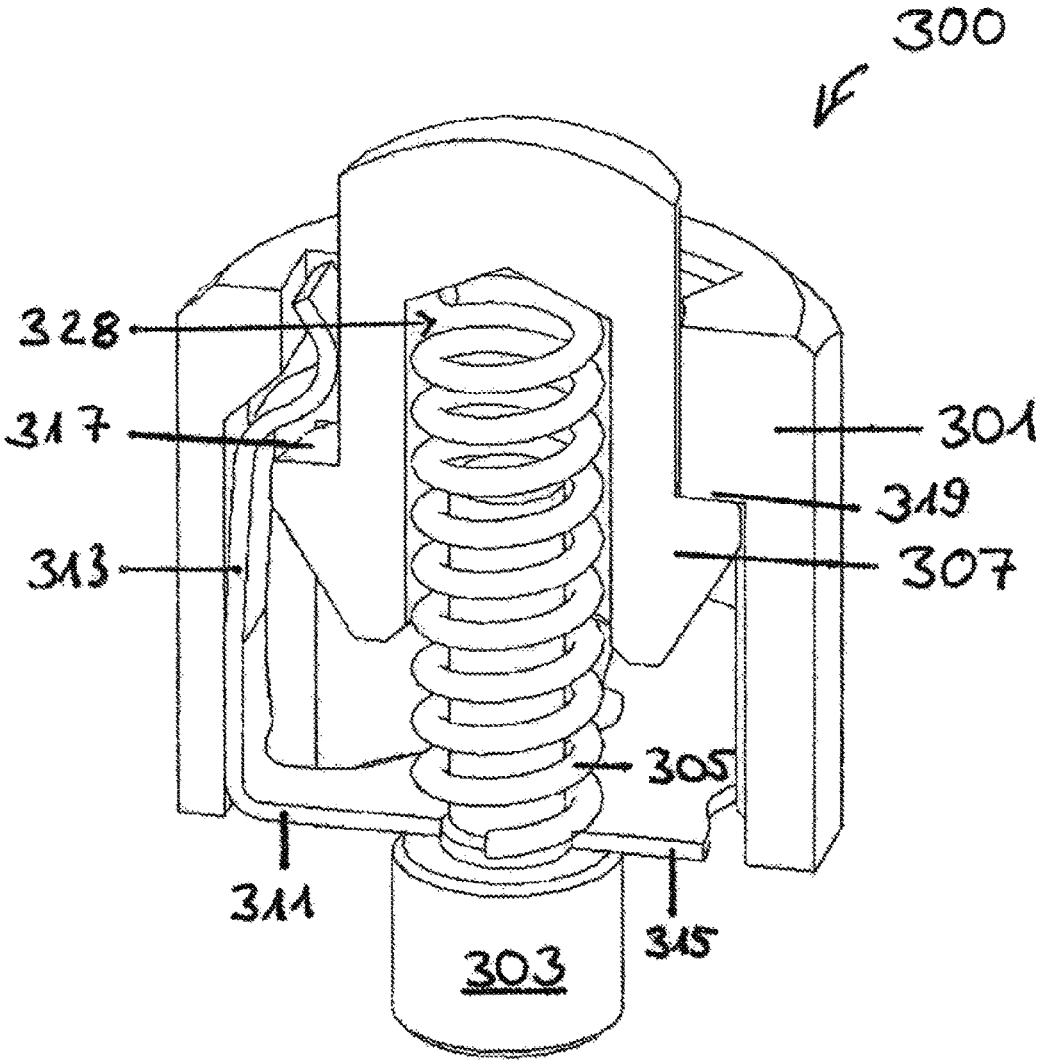
FIG. 2 shows a further embodiment of a spring-loaded contact pin according to the invention.
Figure 3:
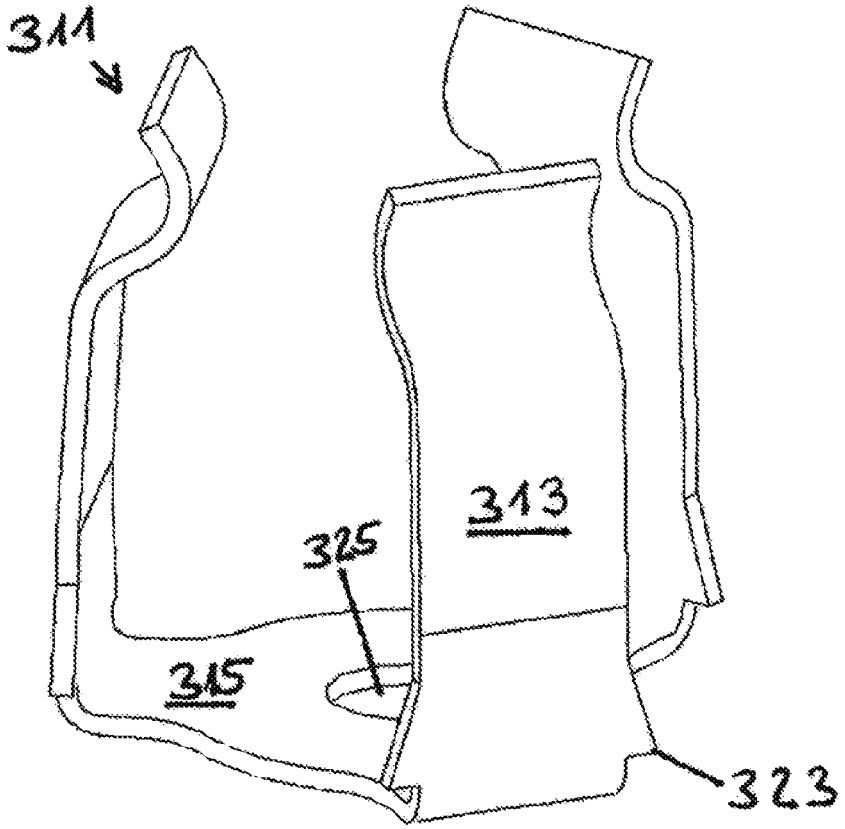
FIG. 3 shows a contact element of a spring-loaded contact pin according to FIG. 2 and according to the invention.
Figure 4:
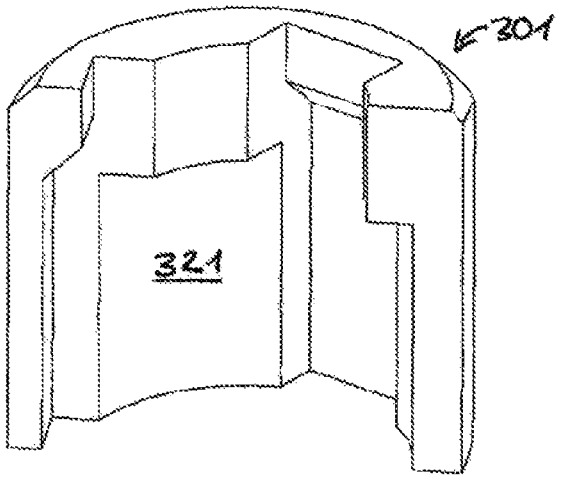
FIG. 4 shows a sleeve of a spring-loaded contact pin according to the invention and according to FIG. 2.

FIGS. 2, 3 and 4 are described in general below.

FIG. 2 shows a schematic view in section of a spring-loaded contact pin 300 according to a further alternative embodiment.

FIG. 3 shows a schematic perspective view of a contact element 311 according to the invention and to FIG. 2.

FIG. 4 shows a schematic view in section of a plastic sleeve 301 according to the invention and to FIG. 2.

The spring-loaded contact pin 300 has a plastic sleeve 301, a fastening element 303 which is designed as a bolt, a spring 305, a piston 307 and a contact element 311.

The plastic sleeve 301 has an abutment element 319. The abutment element 319 interacts with a step 317 of the piston 307. The abutment element 319 prevents the piston 307 from being pushed too far upwards by the spring 305. The plastic sleeve 301 has three guide surfaces 321 to guide the piston 307. The guide surfaces 321 serve to guide the piston 307 when there is an axial movement.

In the plugged-together state, the piston 307 typically is pushed against the abutment element 319 of the plastic sleeve by the spring 305. The properties of the spring 305, in particular the spring travel and spring stiffness are decisive for the plugging force of the spring contact 300 which needs to be applied. The spring travel of the spring-loaded contact pin 300 is approximately 1 mm. The spring 305 is designed as a spiral spring which is wound around the bolt. The piston 307 has a depression 328 corresponding to the spring 305. The spring 307 is placed on the depression 328, over the spring 305.

The fastening element 303 and the bolt passes through a recess 325 of the contact element 311. The fastening element 303 thus forms an abutment for the contact element 311.

The contact element 311 comprises a base region which is designed as a circular ring, and contact tongues 313 integrally formed with the circular ring 315. The circular ring 315 comprises the bore 325, which is dimensioned so that it corresponds to the bolt. The diameter of the circular ring is dimensioned such that the piston 307, the bolt and the spring 305 are arranged radially inside the contact element 311. The contact tongues 313 are bent radially inwards in an upper region in order to contact the piston 307. In this way, at the same time a tolerance compensation is provided by the contact tongues 313 being adapted to the contours of the piston 307 or to the internal contours of the sleeve 301.

LIST OF REFERENCE NUMERALS

100 spring-loaded contact pin
101 sleeve
103 fastening element
105 spring
107 piston
109 head part
111 contact element
113 contact tongues
115 contact ring
117 insulating part
119 thread
300 spring-loaded contact pin
301 sleeve
303 fastening element
305 spring
307 piston
311 contact element
313 contact tongues
315 circular ring
317 step
319 abutment
321 guide surfaces
323 latching element
325 bore
328 depression

The invention claimed is:

1. A spring-loaded contact pin assembly, comprising:
a sleeve;
a spring situated in said sleeve;
a piston situated at least partially in said sleeve; and
a contact element situated at least partially in said sleeve, wherein
said contact element contacts at least one of said sleeve and said piston,
said contact element comprises a base portion and a plurality of elongate resilient contacts that protrude from said base portion,
at least a portion of said spring is situated radially inward of said plurality of elongate resilient contacts,
said spring is situated relative to said plurality of elongate resilient contacts such that an imaginary plane perpendicular to an overall longitudinal axis of said spring intersects said spring and at least one of said plurality of elongate resilient contacts, and
said contact element comprises a latch that latches to said sleeve.

2. The assembly of claim 1, wherein:
said contact element comprises an opening that extends through said base portion.

3. The assembly of claim 2, comprising:
a peg-shaped fastening element that extends through said opening into a central region of said spring.

4. The assembly of claim 1, wherein:
each of said plurality of elongate resilient contacts protrudes from said base portion in a direction generally perpendicular to a major surface of said base portion.

5. The assembly of claim 1, wherein:
at least one of said plurality of elongate resilient contacts has a first end joined to said base portion and a second end that contacts said piston.

6. The assembly of claim 1, wherein:
said spring is situated relative to said plurality of elongate resilient contacts such that an imaginary plane perpendicular to a longitudinal axis of said spring intersects said spring and each of said plurality of elongate resilient contacts.

7. A spring-loaded contact pin assembly, comprising:
a sleeve;
a spring situated in said sleeve;
a piston situated at least partially in said sleeve; and
a contact element situated at least partially in said sleeve, wherein
said contact element contacts at least one of said sleeve and said piston,
said contact element comprises a base portion and a plurality of elongate resilient contacts that protrude from said base portion,
a longitudinal axis of said spring is generally perpendicular to a major surface of said base portion, and
at least a portion of said spring is situated in a hollow in said piston.

8. The assembly of claim 7, wherein:
said contact element comprises an opening that extends through said base portion.

9. The assembly of claim 7, wherein:
each of said plurality of elongate resilient contacts protrudes from said base portion in a direction generally perpendicular to a major surface of said base portion.

10. The assembly of claim 7, wherein:
said contact element comprises a latch that latches to said sleeve.

11. The assembly of claim 7, wherein:
at least one of said plurality of elongate resilient contacts has a first end joined to said base portion and a second end that contacts said piston.

12. The assembly of claim 7, wherein:
said spring is situated relative to said plurality of elongate resilient contacts such that an imaginary plane perpendicular to a longitudinal axis of said spring intersects said spring and at least one of said plurality of elongate resilient contacts.

13. The assembly of claim 7, wherein:
said spring is situated relative to said plurality of elongate resilient contacts such that an imaginary plane perpendicular to a longitudinal axis of said spring intersects said spring and each of said plurality of elongate resilient contacts.

14. A spring-loaded contact pin assembly, comprising:
a sleeve;
a spring situated in said sleeve;
a piston situated at least partially in said sleeve;
an insulating element, situated in said sleeve, that insulates said piston from said spring; and
a contact element situated at least partially in said sleeve,
said contact element contacting at least one of said sleeve and said piston, and
said contact element comprising a base portion and a plurality of elongate resilient contacts that protrude from said base portion.

15. The assembly of claim 14, wherein:
said contact element comprises an opening that extends through said base portion.

16. The assembly of claim 14, wherein:
said insulating element comprises a hollow, at least a portion of said piston being situated in said hollow.

17. The assembly of claim 14, wherein:
said piston comprises a thread at an end of said piston proximate to said spring.

18. A spring-loaded contact pin assembly, comprising:

a sleeve;

a spring situated in said sleeve;

a piston situated at least partially in said sleeve; and a contact element situated at least partially in said sleeve, wherein said contact element contacts at least one of said sleeve and said piston, said contact element comprises a base portion and a plurality of elongate resilient contacts that protrude from said base portion, at least a portion of said spring is situated radially inward of said plurality of elongate resilient contacts, said spring is situated relative to said plurality of elongate resilient contacts such that an imaginary plane perpendicular to an overall longitudinal axis of said spring intersects said spring and at least one of said plurality of elongate resilient contacts, and at least a portion of said spring is situated in a hollow in said piston.

* * * * *